US006009369A

United States Patent [19]

Boisvert et al.

[11] Patent Number: 6,009,369

[45] **Date of Patent: *Dec. 28, 1999**

[54] VOLTAGE MONITORING GLOW PLUG CONTROLLER

[75] Inventors: Mario Boisvert, Reed City; David W. Shank, Big Rapids, both of Mich.

[73] Assignee: Nartron Corporation, Reed City, Mich.

[ * ] Notice: This patent is subject to a terminal disclaimer.

[21] Appl. No.: 08/931,470

[22] Filed: Sep. 16, 1997

Related U.S. Application Data

[63] Continuation-in-part of application No. 08/508,063, Jul. 27, 1995, Pat. No. 5,729,456, which is a continuation-in-part of application No. 08/042,239, Apr. 1, 1993, Pat. No. 5,570,666, which is a continuation-in-part of application No. 07/785,462, Oct. 31, 1991, abandoned.

[51] Int. Cl.[6] ..... G06G 7/70; F02N 17/00; F02P 9/08

[52] U.S. Cl. ..... 701/99; 701/102; 123/145 A; 123/179.21; 123/179.6; 219/492; 219/497; 219/486

[58] Field of Search ..... 701/99, 104, 113, 701/114, 102; 123/179 H, 179 G, 145 A, 179.21, 179.6, 142.5 E, 493; 219/486, 492, 497, 501, 506, 202, 205, 493, 499, 508; 361/265, 757

[56] References Cited

U.S. PATENT DOCUMENTS

| | | | |
|---|---|---|---|
| 4,088,109 | 5/1978 | Woodruff et al. | 123/179 H |
| 4,137,885 | 2/1979 | Van Ostrom | 123/179 H |
| 4,300,491 | 11/1981 | Hara et al. | 123/179 H |
| 4,312,307 | 1/1982 | Cooper | 123/145 A |
| 4,318,374 | 3/1982 | Yasuhara | 123/179 G |
| 4,337,389 | 6/1982 | Bell | 219/511 |
| 4,375,205 | 3/1983 | Green | 123/179 H |
| 4,511,792 | 4/1985 | Kawamura | 219/499 |
| 4,512,295 | 4/1985 | Hanson | 123/145 A |
| 4,516,543 | 5/1985 | Abe et al. | 123/179 H |
| 4,607,153 | 8/1986 | Ang et al. | 219/497 |
| 4,639,871 | 1/1987 | Sakai et al. | 123/493 |
| 4,658,772 | 4/1987 | Auth et al. | 123/145 A |
| 4,694,145 | 9/1987 | Romstadt et al. | 219/497 |
| 4,744,747 | 5/1988 | Kawamura et al. | 431/36 |

(List continued on next page.)

*Primary Examiner*—Jacques H. Louis-Jacques
*Attorney, Agent, or Firm*—Watts, Hoffman, Fisher & Heinke Co.

[57] ABSTRACT

An electronic control system and a device is disclosed proving improved control and diagnostics of glow plugs as are typically energized in diesel engines prior to and during cold start and also during engine warmup, especially for motor vehicles under human operator control. These improved control functions result in: Increased life of the glow plugs, longer service life, greater reliability, a simplified maintainence diagnostic interface, greater diagnostic capability, reduced emission of undesirable hydrocarbons, reduced unburned fuel as white smoke, more complete fuel combusion, reduced lubricating oil contamination, quiter and smoother operation, increased engine power, reduced fuel consumption, and quicker engine warmup all by controlling power applied to the glow plugs based upon electronically controlled fixed and/or adaptive functional algorithms based upon input variables such as battery voltage, glow plug voltages, glow plug currents, engine temperature based upon algorithms which can correct for sensing system hysteresis and time lag, ambient air termperature ambient air density, ambient air humidity, fuel injector duration and timing, intake mass air flow, exhaust gas composition, exhaust gas temperature, alternator output, engine speed, engine torque, engine power, engine compression, engine age, fuel type, and the like for affecting an on and off cycling using open loop control and/or closed loop feedback control of glow plug power so as to maintine glow plugs more closely within an optimal temperature range specific to engine system operational conditions and consistent with improved glow plug life.

34 Claims, 9 Drawing Sheets

U.S. PATENT DOCUMENTS

| | | | |
|---|---|---|---|
| 4,862,370 | 8/1989 | Arnold et al. | 701/113 |
| 4,939,347 | 7/1990 | Masaka et al. | 219/492 |
| 5,144,922 | 9/1992 | Kong | 123/145 A |
| 5,241,929 | 9/1993 | Grassi et al. | 123/145 A |
| 5,287,831 | 2/1994 | Andersen et al. | 123/179.3 |
| 5,327,870 | 7/1994 | Boisvert et al. | 123/145 A |
| 5,413,072 | 5/1995 | Andersen et al. | 123/145 A |
| 5,507,255 | 4/1996 | Boisvert et al. | 123/145 A |
| 5,570,666 | 11/1996 | Rymut et al. | 123/145 A |
| 5,729,456 | 3/1998 | Boisvert et al. | 701/99 |

VOLTAGE MONITORING GLOW PLUG CONTROLLER

CROSS REFERENCE TO RELATED APPLICATIONS

The present application is a continuation in part of application Ser. No. 08/508,063, filed Jul. 27, 1995, now U.S. Pat. No. 5,729,456 which is a continuation-in-part of U.S. patent application Ser. No. 08/042,239 filed Apr. 1, 1993, now U.S. Pat. No. 5,570,666, which is a contination-in-part of Serial No. 07/785,462, filed on Oct. 31, 1991, now abandoned the subject matter of these applications is incorporated herein by reference.

FIELD OF THE INVENTION

The present invention concerns a glow plug controller for use in activating diesel engine glow plugs with a signal to control power to warm the glow plugs prior to initiating combustion and for maintaining a signal to control power that continues to warm the glow plugs after combustion has been initiated.

BACKGROUND ART

Diesel engines are substantially different from the standard 4 or 2 cycle, sparked ignition internal combusion engines. The diesel engine does not have a sparking device such as a standard spark plug. Fuel is ignited when fuel and hot compressed air are mixed in the engine cylinder(s). For this ignition to occur efficiently, the engine must be brought to a temperature at or above a given minimum operating temperature, i.e. a cold diesel engine will not achieve ignition and run efficiently.

A preferred method for heating a diesel engine prior to initial startup is to use electric "glow plug" heaters. These heaters serve to bring the diesel engine up to an efficient operating temperature before the engine is started. Ideally glow plug heaters will rapidly bring a diesel engine up to a desired starting temperature in a "pre-glow" period. After the engine has started, the glow plugs will go into an "after glow" period where they will operate sufficiently long to maintain desired engine temperature until engine self-heating reaches an efficient sustain point. The glowplugs also enable the engine to run smoothly during an initial idle and minimize emission of white smoke due to incompletely burned fuel. Once an engine can sustain its operating temperature, the glow plug is turned off.

U.S. Pat. No. 4,882,370 to Arnold et al shows a solid state microprocessor controlled device for regulating certain aspects of glow plug performance. The Arnold circuitry adjusts the duty cycle of glow plugs as a function of temperature, regulates preglow function, and detects undesirable short circuits and open circuits for implementing a disable function. U.S. Pat. No. 4,300,491, to Hara et al., achieves a variable time control of the preglow period by means of a plurality of transistors and diodes. Van Ostrom, U.S. Pat. No. 4,137,885 describes means for cyclicly interrupting a glow plug energizing circuit when a maximum temperature is reached. Cooper, U.S. Pat. No. 4,312,307 describes circuitry for control of the duty cycle of glow plugs by means of heat-sensitive switches.

SUMMARY OF THE INVENTION

A glow plug controller constructed in accordance with the present invention controls operation of a diesel engine that provides motive power to a motor vehicle. An electric power source mounted to the motor vehicle provides a voltage signal. A glow plug controller circuit is powered by the power source. A voltage source monitor is coupled to the glow plug controller for providing a signal indicative of power applied to the one or more glow plugs. A switching device coupled to the glow plug controller and the electric power source energizes the one or more glow plugs for a controlled time duration prior to initiating combusion in the diesel engine. The glow plug controller includes an adaptive control program for adjusting at least the time duration prior to combustion of the one or more glow plugs based on the power delivered to the glow plugs.

A preferred embodiment of the invention is accomplished using a microprocessor. Use of a microprocessor as a preferred control circuit enables self adaptive control based upon sensor and electrical inputs of variables such as: battery voltage, glow plug voltages, glow plug currents, engine temperature. Such control also achieves sophisticated diagnostics and reprogrammability (as, for example, at various service increments of specified numbers of hours and/or miles of engine life with anticipated subsequent loss of engine compression) as well as precise unit to unit repeatability. Such algorithms can correct for sensor hysteresis and time lag, ambient air temperature, ambient air density, ambient air humidity, intake mass air flow, exhaust gas composition, exhaust gas temperature, alternator output, engine speed, engine torque, engine power, accelerator throttle position, fuel consumption, engine compression, engine mileage, engine operational hours, fuel type and the like to affect an on and off cycling control using open loop control and/or closed loop feedback control of glow plug voltage and/or current to maintain glow plugs more closely within an optimal temperature range specific to needs based upon engine system operational conditions. Microprocessors as controllers show improvements over some non-digital components and elements which can often exhibit performance characteristic variations based upon temperature, time and applied voltage.

Very significant input information processed by the microprocessor is engine temperature, glow plug voltage, and glow plug current. Engine temperature can typically be determined by various sensing devices of types including, but not limited to: Thermistors, positive temperature coefficient resistor, negative temperature coefficient resistor, resistance temperature device, temperature sensing diode, integrated circuit sensor, bimetal device, and gas pressure bulb.

Algorithms and/or circuitry within the control module can give predictive correction to actual cylinder temperature based upon the known and/or actively determined hysterical and time lag nature of various types of locations of temperature sensors. Glow plug voltage is relatively simple to measure directly from the power relay terminal connected to the glow plug(s). Glow plug current can be determined by conducting it through a low value series resistor and determining the voltage drop as being proportionately linear with the current. This series resistor can be configured as an inductor having a ferromagnetic core of various choices of geometry and with an inverse parallel freewheeling diode such that it will have a characteristic RL electrical rise time such that its current levels will be significantly lower than for a resistive glow plug alone during the time of mechanical contact bounce of the power relay. Thus reliability of the relay contacts can be enhanced by reduction of high current contact bounce.

In an alternative embodiment the voltage applied directly to each glow plug (and/or all glow plugs as one) can be also applied directly to a heater element thermally integral with a bimetallic-type switch being also thermally integral with the diesel engine such that the bimetal switch in astable operation will have closed time to enable glow plug relay energization thus affecting functional intrinsic regulation of glow plugs on times based upon both engine temperature and upon applied glow plug voltage. As a variant of this electrical voltage sensing method, the electrical current passing through a glow plug (or all glow plugs) can also pass in series through a conceptually similar bimetallic switch heater, although being designed as a lower resistance value and for higher current than a voltage driven heater, thus a measure of functional electrical short glow plug current limitation is imparted such that the glow plug short circuit on time would be significantly reduced relative to the method whereby only the glow plug voltage is sensed. An optional variant on this concept is to have two heaters on the bimetallic switch such that one is energized by glow plug voltage and the other energized by glow plug current. Another optional variant on this concept is to have one or more heaters on the bimetallic switch such that the heaters are provided with functional drive signals representative of glow plug voltage and/or current and/or calculated power such that the heater energization results in appropriately engineered astable glow plug relay operation. Sensing of both voltage and/or current can be used to affect wider ranging functional control over normal and abnormal glow plug operating characteristics.

The information can be determined from the above inputs and sensors for control of appropriate engine glow plug operation is of two basic types—the necessary versus the actual glow plug heat and temperature for engine operating conditions. Analog signal and sensor information can be converted into digital information by separate interface circuitry or by an analog-to-digital converter (integral with some digital microprocessors) for computational processing in the digital control algorithm. It is possible, although less likely to be commercially produced due to cost and performance factors, that digital signals can also be converted into analog signals for processing and/or reprocessing by analog and/or digital circuitry.

Determination of actual glow plug temperatures for interactive adaptation of glow plug energization timing control can be performed by circuitry which can monitor glow plug resistance typically during off times by one of various methods including: Voltage drop for a fixed current, current for a fixed voltage, voltage in a resistive voltage divider, time based decay with capactitive source, and alternatively by an integral platinum resistance temperature device. These methods make use of the fact that many resistors have some temperature coefficient of resistance such that the absolute resistance and/or relative resistance changing with temperature and time can be determined in precise manner. Glow plug resistance can be monitored and correlated with glow plug temperature and also with engine temperature for adaptive control of glow plug energization times to reduce excessive glow plug temperatures and also to reduce insufficient glow plug heat and temperatures for improved engine starting and warm up. One resistance determination circuit, rather than multiple dedicated resistance determination circuits, can be switched among numerous glow plugs to determine their resistance characteristics.

The glow plug controller can modify the operation of the glow plugs in response to functional algorithms based upon various inputs from potentially diverse digital and/or analog sources. Based upon functional information of integrated engine operational time, temperature, and/or loading the glow plug controller can compensate for engine wear and subsequent reduction in compression ratio by increasing the preglow heating time and afterglow heating times for improved starting and warmup. Engine wear and compression loss can be compensated for by the microprocessor via various methods including: Self reprogramming based upon monitored engine operational parameters, manual reprogramming the microcomputer at specified service mileages and/or times, manual reprogramming and entering of measured compression readings for each cylinder at various service mileages and/or dates, and manual clipping of jumper wires and/or setting of switches on the printed circuit board based upon mileage and/or compression. Lower air density, lower air pressure, and/or lower battery voltage can be compensated for by the controller by increasing preglow time, increasing afterglow on time duty cycle, and increasing afterglow cycle period for increase in glow plug heat and temperature sufficient to improve engine starting and warmup.

Some vehicle applications use or have available for use system multiplex (MUX) and demultiplex (DEMUX) data, control, and address bus lines at one or more communication nodes, possibly supported by a host MUX module, upon which some of or all of the above information is regularly available or can be made available on an as needed basis to the glow plug controller. In some cases data is periodically broadcast onto the MUX system, in other cases data is broadcast irregularly to the MUX system, and in other cases data is broadcast only when polled or requested. In general, the thermal time constants involved for glow plug heating and cooling are on the order of several seconds, which is orders of magnitude of the typical times required for a polling and receiving of MUX bus information from remote nodes, therefore a MUX system is generally suitable in terms of timing capability for collecting various inputs from diverse locations and for outputting signals to the power switching relays to perform all of the functions described herein. Improved functions of the glow plug controller can be implemented via separate modules interconnected and communicating via system MUX node and/or dedicated wiring for incorporating additional input and output functions, features, and capabilities such that system inputs, functional algorithm processing control, and power switching output as discrete modules are not necessarily physically integral or even proximal.

A desired function incorporates a memory circuit to disable preglow heating if the engine run switch when switched from off to run has been in the switch off position for less than three minutes after previous running or preglow heating. This disables the circumstances where a human operator activates the run switch off and on repeatedly causing fixed preglow heating times to be repeated in close succession, resulting in possible overheating of the glow plugs.

An optional function for potential incorporation into the glow plug controller is a variable delay until the alternator is at a sufficiently safe and low speed and thus low output, as determined from the frequency component of the alternator R-tap connection, to deenergize the glow plugs after the ignition switch is changed from the run to the off position during the afterglow 2 cycle on time thus reducing the potentially damaging and dangerous voltage spike generated by instantaneous discontinuation of high glow plug current through the inductive coils of the alternator. The need for this is because the battery connection to the alternator is typically dropped out immediately when the switch is changed from the run position to the stop position and the integral voltage regulator within the alternator maintains alternator field current such that the alternator can continue output load current therefore switching off of the high glow plug current when sourced solely from and through the inductive alternator is likely to cause a much higher voltage spike and much more energetic relay contact arc than when switching of this high current when sourced solely from or in parallel with the electrochemical storage battery which acts as a voltage limiting sink for the energy spike. The energy stored in an inductor is equal to (½)(inductance)(square of current), inductance being measured in units of Henry, current being measured in units of Ampere, energy being expressed in units of Joule. It is readily seen that for currents on the order of 150 Amps, the stored inductive energy is significant and for an automotive nominal 12 Volt application can exceed 100 Volts with durations above 32 Volt for approximately 400 milliseconds. Load dump can be damaging to various vehicle components, especially the voltage regulator which is typically integrated with the alternator, and can also be lethal to an electrically shorted human. For a nominal 24 Volt vehicle operating system, load dump spikes are even more of a voltage concern to vehicular electrical components and also to humans. Functional monitoring and controlled avoidance of the conditions which can lead to production of alternator sourced load dump of inductive energy spikes with associated voltage spikes can lead to very significant reduction of: Detrimental voltage stress on vehicle components, reliability reducing glow plug relay contact arcing, and potentially lethal conditions.

Another optional functional feature is the use of more than one power relay, contactor, or solid state switch for switching power on and off to individual glow plugs or groups of glow plugs, ideally, at least one switch device for each glow plug. Switching power to each glow plug independently allows for practical application of multiple solid state switches rated for currents in the 20 to 30 Amp range having additional benefits of: Small size, lightweight, audibly quiet, an order of magnitude increase in number of switch cycles per life, reliability, no contact bounce, and no contact bounce associated conducted and/or field emissions. Multiple switches allow improved output control of each individual glow plug or group including such functions as: Independent timing, independent disabling due to excessive short circuit condition, and dependent switching on and off individual glow plugs or groups at differing times for reduction of switching transients and dump spike magnitudes. Use of individual switching for each glow plug can allow completely independent and individual fixed and/or varying switch control timing functions of preglow time, afterglow times, afterglow cycle on times, afterglow duty cycle, afterglow cycle periods, and the like for each glow plug based upon its actual operating conditions including inputs of and/or calculated values for: Voltage, current, power, resistance, temperature, engine age, associated cylinder compression ratio, ambient air conditions, and the like.

The glow plug controller can incorporate additional features such as shielding, transient protection, and filtration of electrical noise over wide ranging frequencies (including zero Hz) and of interference types including: Conducted transients, electrostatic discharge, load dump, reverse voltage, magnetic fields, electric fields, and electromagnetic fields. Due to the sensitive and high frequency electronics within the control module and in cases of integral control and power switching within the same control module, it may be necessary to include shielding and/or filtration for protection of: Module components from each other, module components from outside sources of noise, and outside components from noise produced within the module. Additional concepts include additional interface communication and control features allowing service monitoring of historical and present operation plus modification control of glow plug functional algorithm control parameters.

One embodiment of the invention has application with heavy-duty military vehicles such as trucks, infantry fighting vehicles, tanks, and others. Because such vehicles are typically operated by a large number of operators having different skill levels, considerable warning and protection equipment is incorporated into such vehicles. This warning and protection equipment includes means for informing an operator of the operations and conditions of the vehicle.

Heavy-duty vehicles of this nature include switching mechanisms for selectively disconnecting all or a part of the electrical loads from a battery which is used to provide electrical power for the vehicle. This function is sometimes called "load dumping." Generally, the load dumping is controlled by electronics which senses engine shut-off and commands a solenoid to drop out the vehicle loads after the conditions of ignition switch-off and commands a solenoid to drop out the vehicle loads after the conditions of ignition switch off and engine speed is below 100 RPM's are coincidentally met. Further details of one such system are disclosed in U.S. Pat. No. 5,287,831 to Andersen et al. The disclosure of this patent is incorporated herein by reference.

BEST MODE FOR PRACTICING THE INVENTION

Figure 1A:
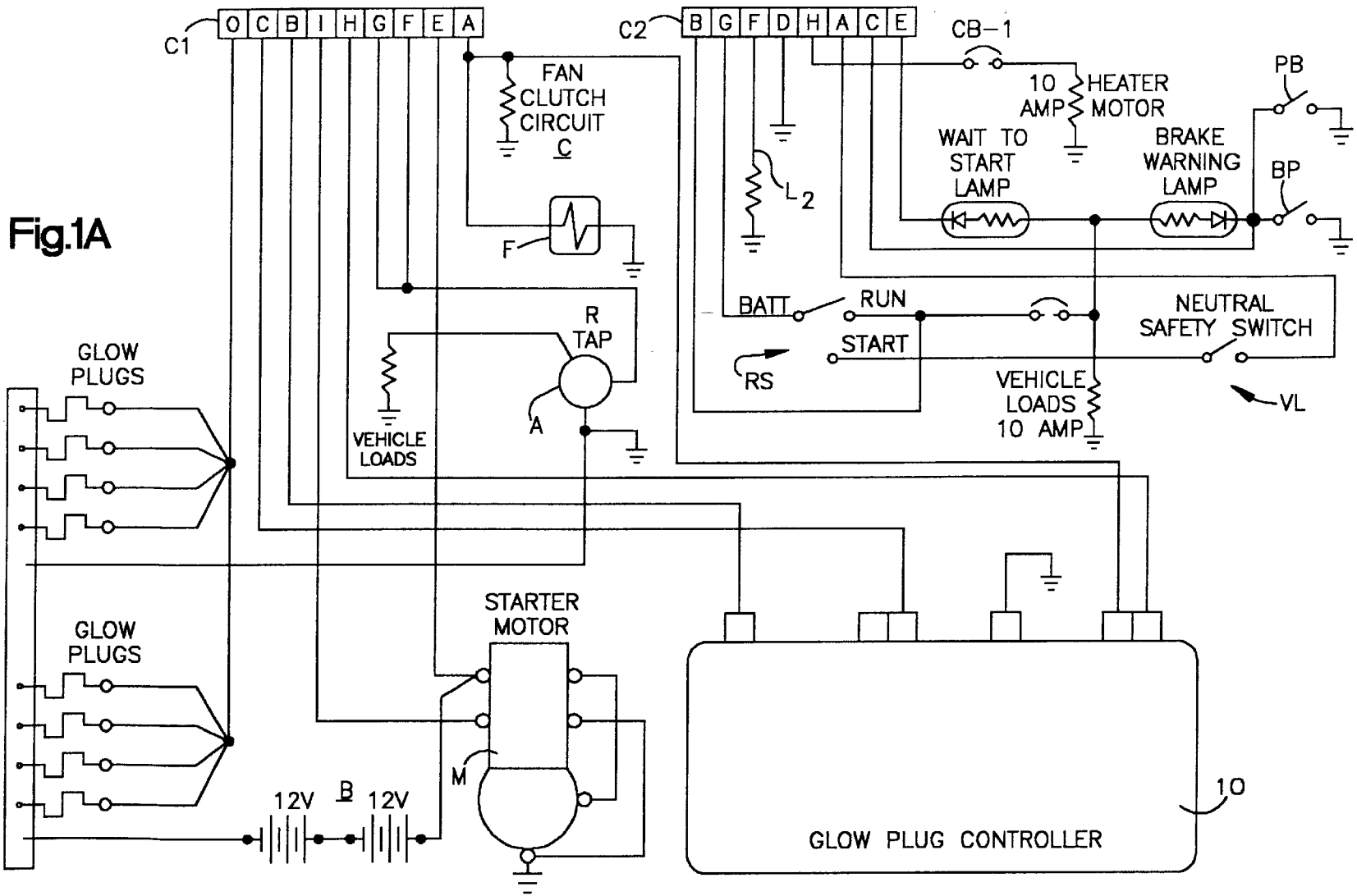
FIG. 1A is a partially schematic, partially block diagram illustrating some of the electrical components of a diesel engine and associated peripheral equipment which form the environment for the present invention.

Toward the left-hand portion of FIG. 1A is a column of eight glow plugs, the uppermost of which is indicated by the reference character G. Operation of the glow plugs is governed by a glow plug controller 10. An electric starter motor M, with associated switching, is provided for starting the engine. Batteries B are provided for selectively actuating the starter motor M, and for providing DC electrical power for operating other electrical components of the vehicle and for peripheral components of the engine as needed. The two series connected vehicle batteries B provide 24 volts DC. A run/start switch RS is provided for actuating the vehicle ignition circuitry and for selectively actuating the starter.

An alternator A, driven by the engine, provides electrical power for charging the batteries B and for providing electrical power to the vehicles loads. The alternator A has an "R tap," (connected to the field) indicated by reference character R. A fuel solenoid F governs flow of fuel to the engine. A clutch control C electrically engages and disengages an electric motor driven engine cooling fan.

A wait-to-start lamp W provides a visual indication to an operator when the preglow cycle is occurring and it would thus be inappropriate to try to start the diesel engine. A brake warning lamp BW indicates to the operator when a parking brake is set. The brake warning lamp BW also indicates when the start solenoid is engaged. A brake pressure switch BP provides an indication to the operator when a predetermined amount of force is applied to the service brake pedal. A park brake switch PB, indicates by means of the lamp that the vehicle parking brake is set.

The electrical system of the engine operates several types of electrical loads. One such load is a heater motor indicated generally at the reference character H. Lighting loads are connected to a lead generally indicated by the reference character LL. Certain miscellaneous electrical vehicle loads are indicated by the resistor at reference character VL.

The present invention, as will be described in detail, includes improved circuitry and sub-circuits for governing and safe-guarding operation of the known components illustrated in FIG. 1A. Interfaces for connecting the known components of FIG. 1A are provided by an engine connector C1 and a body connector C2, both illustrated in FIG. 1A. These connectors interface between the glowplug controller 10 and the engine and vehicle components shown in FIG. 1A.

Figure 1B:
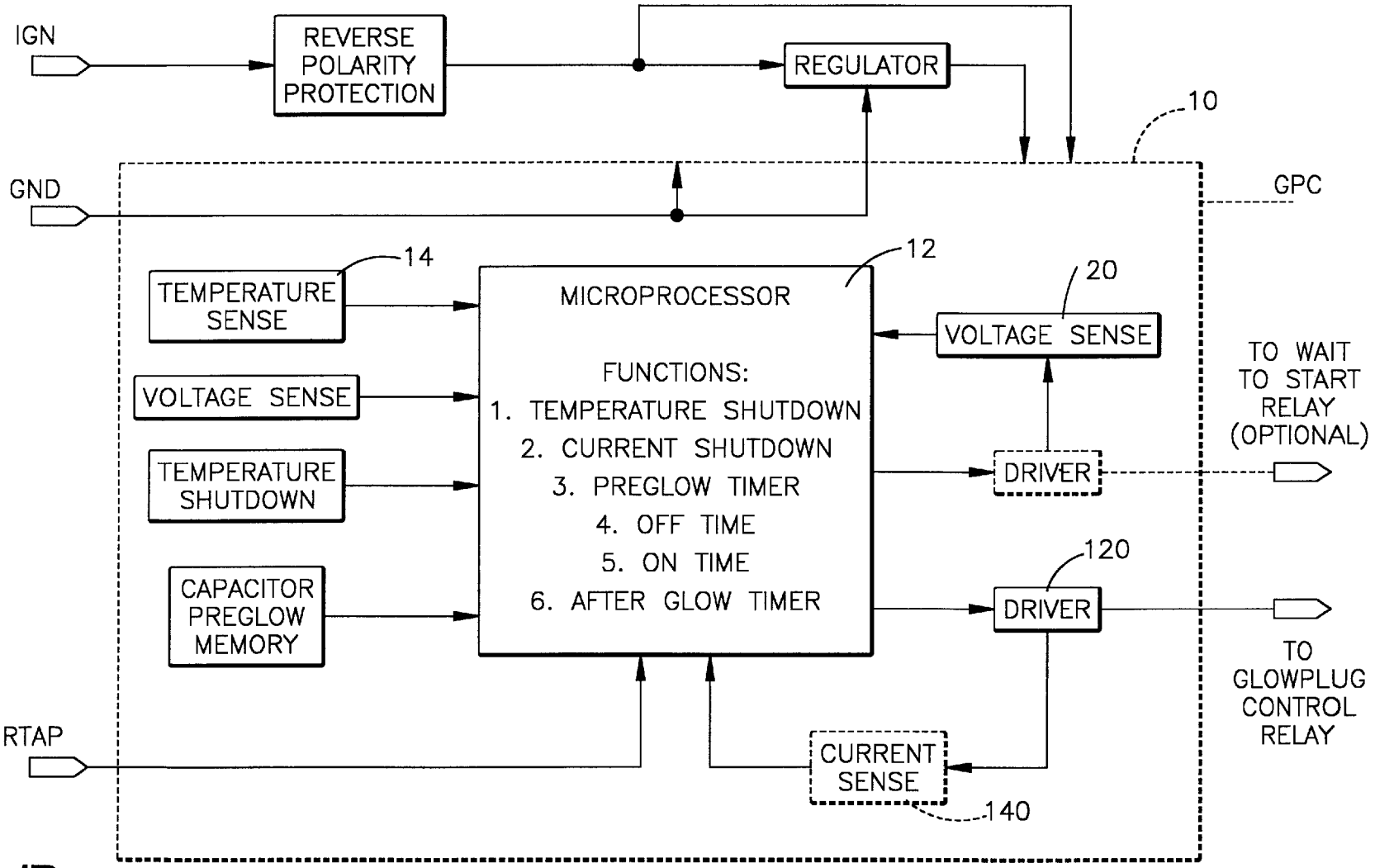
FIG. 1B is a block diagram of a microprocessor controlled glow plug controller for activating a glowplug.

FIG. 1B is an overview of the control functions performed by a microprocessor operated glowplug controller 10 used to control a time duration of glow plug activation for a diesel engine having one or more glow plugs. A microprocessor 12 forms part of a glow plug controller as do a number of condition monitoring circuits for using to control engine glow plug energization. The microprocessor is used for inputting digital and analog signals from sensors and other inputs, digitizing the inputs as required, signal processing in accordance with a control program and outputting signals to control glow plug function.

Figure 2A:
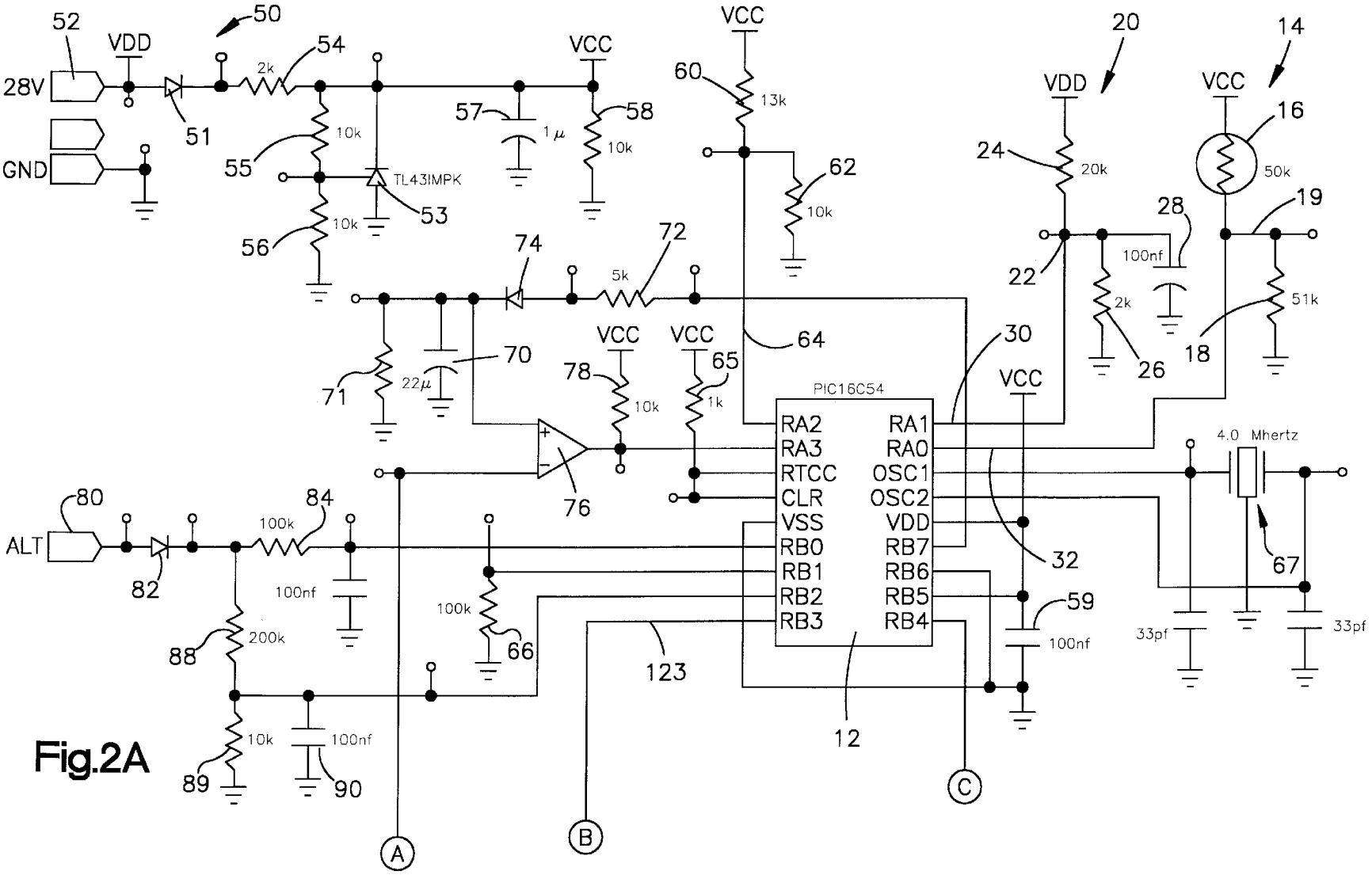
FIGS. 2A and 2B are detailed schematics that disclose details of the FIG. 1B controller.
Figure 2B:
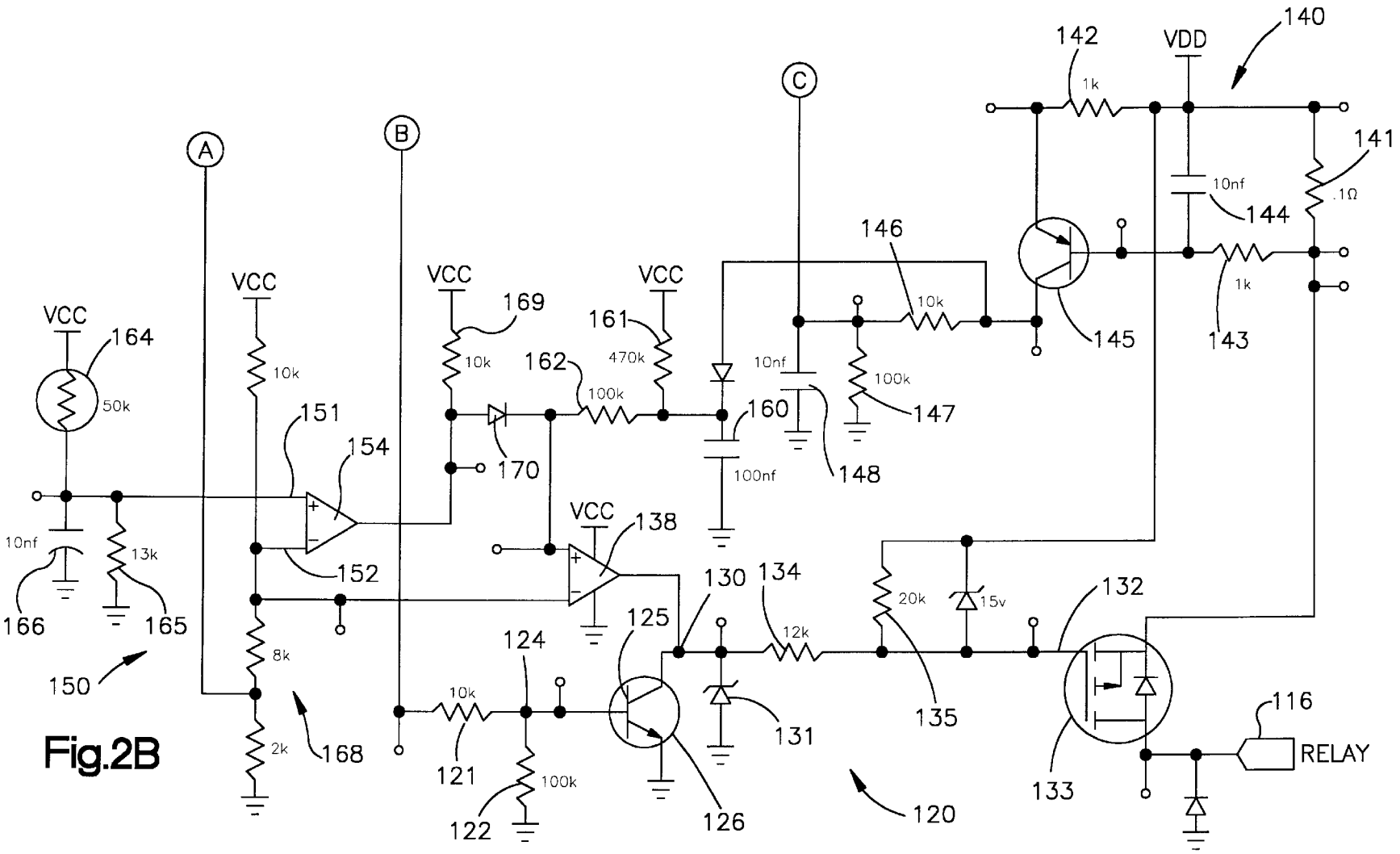

The controller 10 latches a power input from the ignition and reads the engine temperature from a temperature sensor 14 (FIG. 2B) located in close proximity to a housing which encloses the controller. The temperature sensor 14 includes a thermistor 16 and resistor 18. Temperatue is read at the junction 19 between the thermistor and the resistor and coupled to pin RA0 of the microprocessor 12. Internally within the microprocessor, the input signal from the junction 19 is converted from an analog input to a digital signal for subsequent signal processing.

A battery voltage sensing circuit 20 is coupled to the microprocessor 12 at pin RA1. Voltage is sensed at a junction 22 (FIG. 2A) between two resistors 24, 26 with a capacitor 28 being a noise filtering capacitor. Internally within the microprocessor, the input signal from the junction 22 is converted from an analog input to a digital signal for subsequent signal processing.

Figure 6:
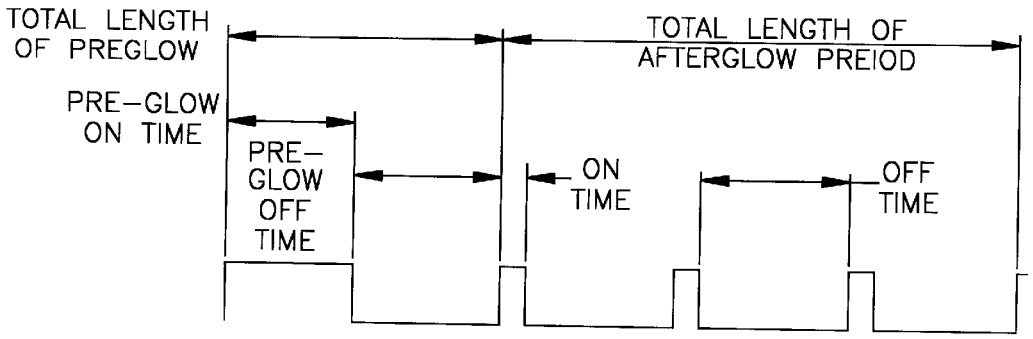
FIG. 6 is an energization sequence of preglow and afterglow periods.

Voltage that is read at two analog to digital ports 30, 32 on the microprocessor 12 and a combination of the two readings i.e. temperature and voltage determines times for pre-glow, on and off, and afterglow cycles. The controller 10 looks up optimum pre-glow time from a table in memory, the memory comprising either an EPROM or a MASK. Pre-glow, afterglow, afterglow cycle period, and afterglow on time duty cyles times versus controller sensed temperature and voltage are illustrated in Table 1 and the meaning of these variable are depicted in FIG. 6. Normal operation consists of an afterglow period that is a function of both temperature and voltage. The preglow period includes an off period during which the microprocessor monitors an alternator signal indicating the vehicle operator has initiated engine operation and diesel combusion has begun. Mere cranking of the engine is not enough to cause a sensing of this signal. The afterglow period of FIG. 6 begins with application of the signal to the microprocessor within the off period of the preglow. If the specified input from the alternator is not received within the specified off period of the preglow, the controller cycle ends and no afterglow occurs.

TABLE 1

| Function After- | Temperature (degrees C.) | Voltage (Volts) | Output "ON" Time (secs) | Output "Off" Time (secs) | Total Glow |
|---|---|---|---|---|---|
| PreGlow | <=50 | <=18 | 11.00+/−.25 | 6.00+/−.25 | |
| PreGlow | <=50 | 22 | 7.30+/−.25 | 6.00+/−.25 | |
| PreGlow | <=50 | 24 | 6.00+/−.25 | 6.00+/−.25 | |
| PreGlow | <=50 | 28 | 4.50+/−.25 | 6.00+/−.25 | |
| PreGlow | <=50 | 32 | 3.40+/−.25 | 6.00+/−.25 | |
| PreGlow | >60 | 32 | 3.40+/−.25 | N.A. | |
| AfterGlow | <=50 | 18 | 1.0+0.2/−0.1 | 3.00+/−.25 | (See |
| AfterGlow | <=50 | 22 | 1.0+0.2/−0.1 | 5.00+/−.25 | Below) |
| AfterGlow | <=50 | 24 | 1.0+0.2/−0.1 | 6.00+/−.25 | |
| AfterGlow | <=50 | 28 | 1.0+0.2/−0.1 | 8.00+/−.25 | |
| AfterGlow | <=50 | 32 | 1.0+0.2/−0.1 | 10.0+/−.25 | |
| AfterGlow | >60 | 16–32 | 0 | 0 | |
| AfterGlow | −40 | 16–32 | 1.0+0.2/−0.1 | (See Above) | 68+/−12 |
| After | −18 | 16–32 | 1.0+0.2/−0.1 | | 53+/−12 |
| RTap | 25 | 16–32 | 1.0+0.2/−0.1 | | 32+/−12 |
| | 40 | 16–32 | 1.0+0.2/−0.1 | | 28+/−12 |
| | 50 | 16–32 | 1.0+0.2/−0.1 | | 25.8+/−12 |
| | 60 | 16–32 | 0 | | 0 |

Power supply circuit

A power supply circuit 50 includes a diode 51 coupled to a battery input 52 and an integrated circuit low voltage drop regulator 53 that produces a five volt output signal Vcc. The diode 51 provides reverse polarity protection. A resistor 54 is a current limiting resistor for the five volt regulator 53. Two resistors 55, 56 form a voltage divider setting the reference feedback voltage to the three terminal regulator. The regulator is a part number TL431 MPK regulator. A capacitor 57 filters the Vcc voltage by storing charge. A resistor 58 draws enough current from the node Vcc to keep the three terminal voltage regulator integrated circuit 53 within its range of operating current and also allows the power supply cirucit 50 to discharge rapidly to implement a power up reset function and a capacitor preglow memory function. A capacitor 59 coupled to a Vdd input to the controller 12 allows the controller to continue to operate for a period after the power input Vcc goes low as the ignition is turned off.

Two resistors 60, 62 are coupled between the five volt regulated signal Vcc and ground. The voltage at a junction between the resistors 60, 62 is coupled to the microprocessor and provides a temperature shutdown reference signal at the microprocessor input 64 at port RA2. This voltage signal allows the microprocessor 12 to compare with an internal signal for safe protective shutdown in the case of excessive internal microprocessor temperature. The value of the resistor 60 is selected from a chart based upon the desired shutdown.

The microprocessor 12 operates from the Vcc signal from the power supply circuit 50. The Vcc signal is coupled to the microprocessor 12 through a pull-up resistor 65. A resistor 66 is provided as a pulldown to ground for microprocessor pin RB1. A clock oscillator 67 resonates at 4 Megahertz.

Upon power up, a resistor 72 and a diode 74 provide a circuit path to charge a capacitor 70 in parallel with a resistor 71. After power is applied, the voltage on the capacitor 70 is coupled to a comparator 76. A second input to the comparator 76 is a reference voltage of 0.5 volts derived from the regulated signal Vcc. If the capacitor 70 has a voltage above 0.5 volts at power up, the ignition switch has been switched to the run positon within the previous three minutes. In this event a preglow time is disabled. The output of the comparator 76 is pulled up to Vcc by a resistor 78 and is input to the microprocessor 12 at pin RA3. If the capacitor 70 has a voltage below 0.5 volts at power up, this causes the comparator 70 to go low resulting in a zero on the pin RA3 and the microprocessor will then enable the preglow time.

An alternator input 80 provides a signal from the RTAP of the alternator and provides an alternating signal having a frequency component which indicates the relative operating speed of the alternator and thus the engine. The signal at the input 80 is rectified by a diode 82 and filtered by a resistor 84 and capacitor 86 and then supplied to the microprocessor 12 at input pin RB0. The microprocessor 12 reads a DC signal indicative of an engine running condition. The voltage level at the input 80 is also stepped down by a voltage divider having two resistors 88, 89 and a capacitor 90 and coupled to pin RB2 of the microprocessor 12 and is used during diagnostic testing of the circuits. If the input 80 is sensed upon powerup of the controller it means that the user started the engine without allowing a preglow. Under these circumstances the controller does not provide any glow plug energization. The input 80 also affects glow plug energization if the engine has been running (as sensed at the input 80) within three minutes of receipt of an ignition input that powers up the microprocessor. If the ignition key is cycled quickly an after-glow cycle is allowed but a pre-glow period is not until 3 minutes has elapsed of an ignition off period. This inhibit function prevents overheating and damage to the glow plugs.

Relay driver

Figure 7:
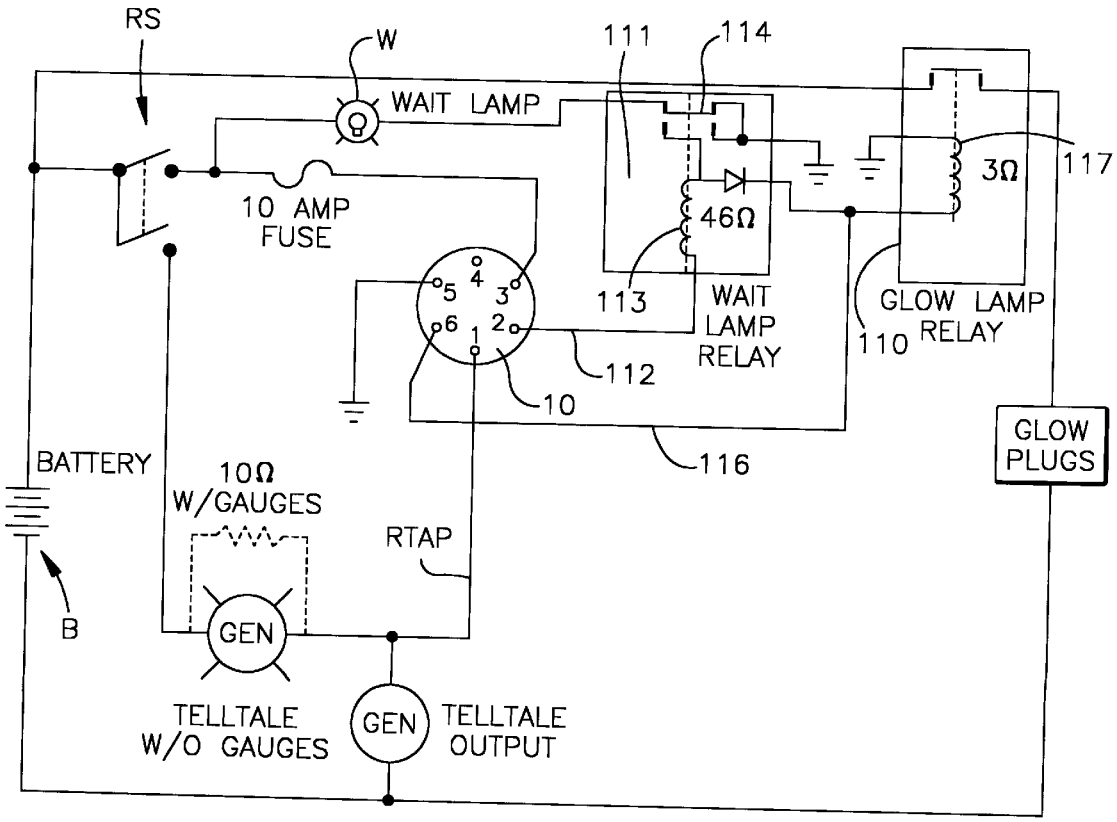
FIG. 7 is a block diagram showing interconnection between a glow plug relay and a indicator lamp relay.

A state of a relay activation circuit 120 that is coupled to the microprocessor 12 activates a glowplug activation relay 110 shown in FIG. 7. The circuit of FIG. 7 also includes a relay 111 for controlling an energization state of the wait to start lamp W. Some motor vehicle manufacturers provide an equivilant circuit to that shown in FIG. 7 that is coupled to the controller 10 by means of the connectors C1, C2. The circuit of FIG. 7 produces a transient protected output 112 from the controller that goes high when the ignition input from the switch RS goes high. The wait to start lamp W is also coupled to the ignition signal and so long as the relay coil 113 is de-energized, the coil contacts 114 are closed to activate the lamp W.

A relay output 116 goes high to energize a coil 117 and activate the glowplugs. This occurs upon receipt of the ignition input. After the pre-glow "on" state of table 1 the output 116 goes low to energize the relay coil 113 and extinquish the lamp W.

The circuit 120 (FIG. 2B) includes two resistors 121, 122 that are coupled to a microprocessor output 123 at pin RB3 and having a junction 124 coupled to a base input 125 of a switching NPN transistor 126 whose conductive state is controlled by the output 123.

At a collector junction 130 of the switching transistor 126 is located a zener diode 131 that protects the collector junction 130 as well as a gate input 132 of a MOSFET transistor 133. Two resistors 134, 135 coupled between the collector junction 130 and the MOSFET gate input act as biasing transistors for the gate 132 of the MOSFET transistor 133 which is driven by the switching transistor 126 or by an open collector pulldown output of a comparator 138.

Over current protection is provided for the transistor 133 by an over current protection circuit 140. A resistor 141 is a shunt resistor which detects over-current in the relay that activates the glowplugs. The resistors 142, 143 and a capacitor 144 act as biasing resistors and providing filtering for a switching transistor 145. The transistor 145 will turn on as the voltage across the resistor 141 exceeds 0.6 volts. The resistors 146, 147 and capacitor 148 are filtering devices to interface with the microprocessor 12. If the current through the resistor 141 becomes excessive, the transistor 145 turns on and turns off the FET 133.

Output relay power up circuit

Unless disabled by a sensed temperature of greater than 50 degrees Celsius, a pulse circuit 150 immediately initiates energization of the relay drive transistor 133 with a pulse upon power up before the approximately 100 milliseconds it takes for the microprocessor 12 to power up and take over functional control. This initial power up function is controlled by circuit inputs 151, 152 to a comparator 154 having an output coupled via the comparator 138 to the collector junction of the switching transistor 126.

These circuit inputs allow an output from the comparator 154 to immediately pull the output low to turn on the transistor 133 via the comparator 138 thus eliminating a race situation with the external circuits for the "wait to start" indicator lamp and its associated external control circuits. At power up, the non-inverting input of the comparator 138 is low and will rise due to the transient charging of a capacitor 160 by a resistor 161 from Vcc, the signal voltage being transmitted via a resistor 162. By the time the capacitor 160 comes up to Vcc the comparator will discontinue its low output and the microprocessor is allowed to control the relay output 116 by the state of the switching transistor 126.

Sensed temperatures above 50 degrees Celsuis will disable the immediate application of power to the glow plug relay. This disabling is performed by a voltage divider coupled to the power supply output Vcc that is made up of a thermistor 164 and resistor 165 and filtered for noise by a capacitor 166 as the non-inverting input 151 to the comparator. A 50 degrees Celsius reference signal at its inverting input 152 comes from a voltage divider 168 formed by the combination of three resistors. The output of the comparator 154 is open collector when off and will therefore allow a resistor 169 to pull up the non-inverting input of the comparator 138 via a diode 170 unless a sensed temperature of greater than 50 degress pulls the anode of the diode low.

Other control parameters

Thus far, there has been disclosed in detail a glow plug controller 10 which controls glow plug operation as a function of engine temperature and sensed battery voltage. The present invention also relates to controlling glow plug operation as a function of other parameters related to a status of engine operation or characteristics, can be used as well by a microprocessor controlled glow plug controller to influence glow plug operation.

For example, engine cylinder compression, in addition to power applied to the glowplugs, can be used as an input to regulate glow plug operation. In such an embodiment, a compression sensor is used to provide an input to the microprocessor digital logic circuitry. The digital logic circuitry responds to the compression sensor information to increase glow plug heating as engine compression decreases.

Sensors of engine cylinder compression are well known in the art. For those not intimately familiar with this technology, however, the following publication, describing such a compression sensor, is hereby incorporated by reference: *SENSORS, THE JOURNAL OF APPLIED SENSING TECHNOLOGY,* "A Fiber-Optic Combustion Pressure Sensor System for Automotive Engine Control", June 1994, pp. 35–42.

Figure 3:
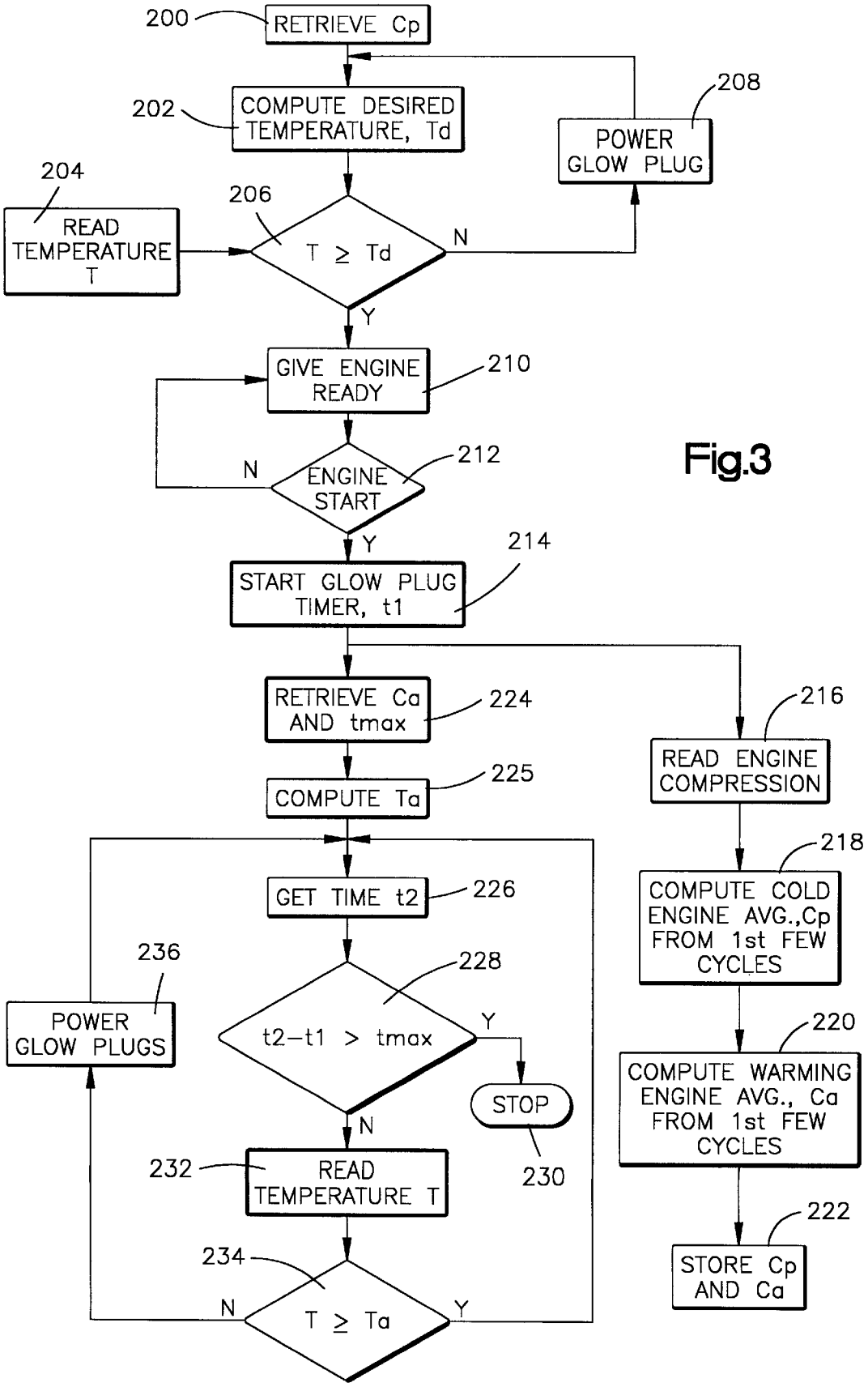
FIGS. 3–5 are flowcharts of a diesel engine modification routine that is used to modify operation of the engine based upon sensed conditions.
Figure 4:
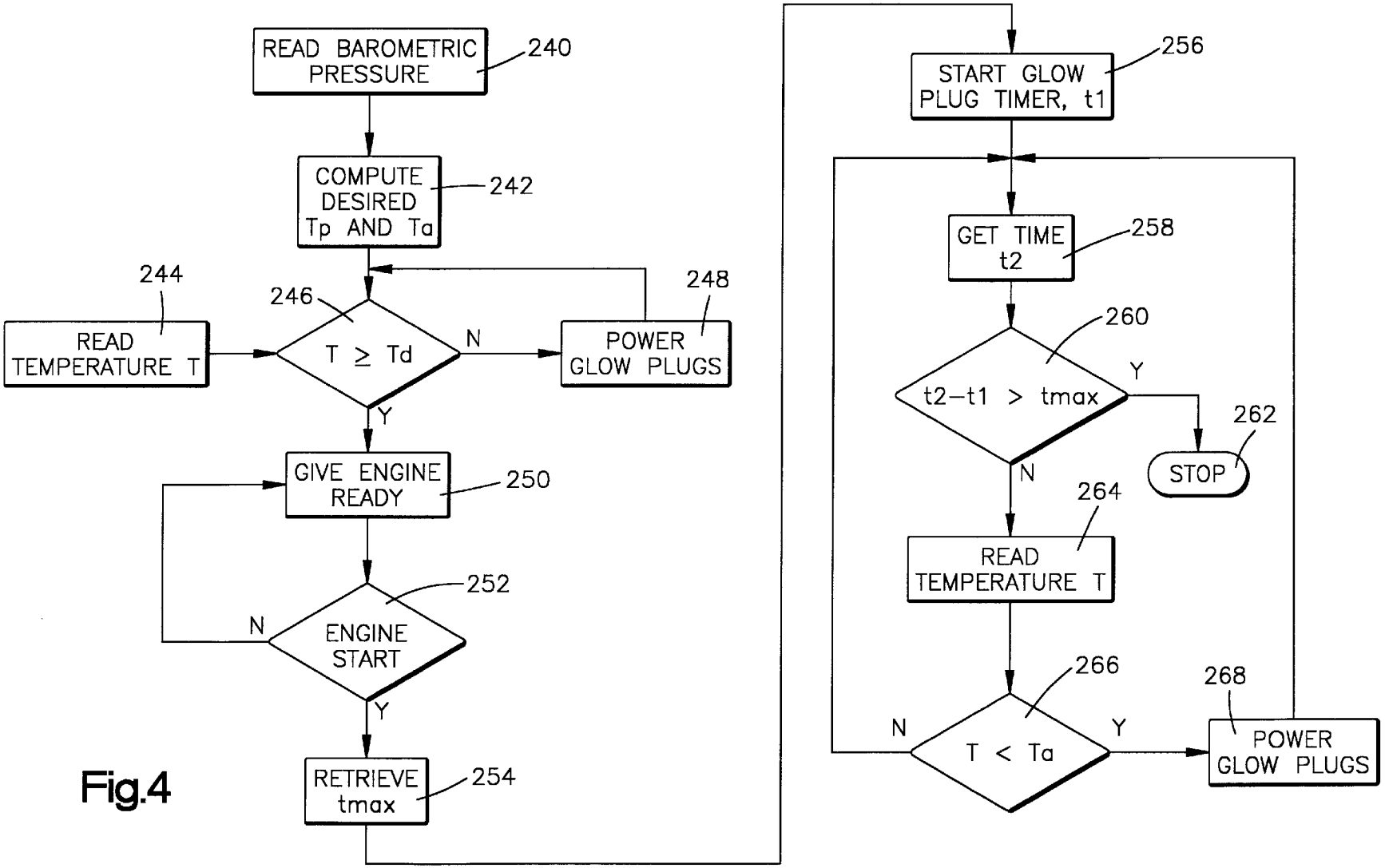

FIGS. 3 and 4 constitute a flow chart describing the manner in which digital logic circuitry, such as a microprocessor is programmed in order to govern glow plug operation as a function of engine temperature and engine compression.

The steps shown in FIG. 3 begin with retrieving 200 the average "Cold Engine" average compression "Cp". "Cp" is as computed and stored in a previous cycle of operation or is a factory set default on the first cycle of operation after a reset. A "look up" table or stored algorithm is then used to compute 202 a desired glow plug temperature "Td" for engine starting. A suitable "look up" table or algorithm could be readily determined from empirical studies of engines spanning a range of "Cold Engine" compression values. Once a "Td" has been determined, the glow plug temperature "T" is read 204. "T" is then compared 206 to "Td." If "T"<"Td", power is applied 208 to the Glow Plug(s). Steps 204, 206 and 208 are then repeated until "T" equals or exceeds "Td".

After "T" has risen to "Td" an "Engine Ready" indication is given 210. This indication can be a light, audible tone, both or other means to indicate to the operator that the engine is ready to be started. In some applications it may be desirable to have the controller initiate an engine start at step 210 instead of merely providing an indication of engine status. The controller then monitors 212 the engine to determine when it actually starts. A common means to detect engine start is to monitor the voltage from the alternator (not shown).

Once the engine start has been detected, the controller begins a timer 214 (t1). During the first few cycles of operation after engine start, the engine compression is read 216 and a "Cold Engine" average compression "Cp" is computed 218. During the first "n" cycles of operation after engine start, the engine compression is read 216 and a "warm Engine" average compression "Ca" is computed 220. Once a "Cp" and a "Ca" have been computed they are stored 222 where they will be available for retrieval the next engine starting sequence.

Concurrent with initiation of the steps 216, 218, 220, 222 the previous "Ca" and a predetermined maximum time "tmax" are retrieved 224. "Ca" is then used to compute a desired glow plug operating temperature "Ta" at step 224. As in step 202, an empirically determined "look up" table or algorithm can be used to compute "Ta". The time "t2" is then measured 226 and the difference "t2–t1" is compared to "tmax" at step 228. If the difference exceeds "tmax", the controller is stopped 230 and power to the glow plug(s) is discontinued. If the difference does not exceed "tmax", the glow plug temperature "T" is read 232 and compared to the desired operating temperature "Ta" 234. If "T"<"Ta", power is applied to the glow plug(s) 236 and steps 226–236 are repeated. If "T" equals or exceeds "Ta", step 236 is skipped and control is transferred back to step 226 where the process can repeat until step 230 is reached.

According to another embodiment, the present invention controls glow plug operation as a function of ambient barometric pressure. Barometric pressure sensors are well known in the art, and, for that reason, will not be described in detail here. Suffice it to say that a barometric pressure sensor is used to provide an analog input to the glow plug controller whose value is a function of barometric pressure. The analog barometric pressure indicating signal is digitized in known fashion, as disclosed above in connection with the engine temperature signal, and then can be processed by the digital logic circuitry, such as a microprocessor, and the output of the microprocessor reconverted to analog form and used to control glow plug operation. As barometric pressure is reduced, the air with which fuel is mixed becomes less dense. Thin air, when compressed, rises less in temperature than does dense air, given the same compression volume ratio. Therefore, it is desirable, when barometric pressure drops, extra heating to effect reliable combustion should be provided by the glow plugs. Accordingly, the present embodiment responds to a decrease in barometric pressure to increase glow plug heating. Usually, the increase in glow plug heating is done by lengthening the time period of pre-glow or after-glow, or by increasing the duty cycle of operation of the glow plugs.

FIG. 4 shows method steps 240–268 a flow chart for use in programming digital logic circuitry for increasing glow plug heating operation as a function of decreasing barometric pressure.

The barometric pressure is read 240 prior to engine startup. A "look up" table or algorithm is then used to compute 242 desired glow plug temperatures "Tp" & "Ta". "Tp" is the desired temperature prior to starting and "Ta" is the desired temperature after engine start. The "look up" tables or algorithm can be readily determined by empirical means by studying engine starting and running characteristics over a range of barometric pressures. For instance, the "Tp" required to start an engine at an elevation of 5,000 feet could be expected to be higher than that required at sea level.

After computation of "Tp" and "Ta" the glow plug temperature "T" is read 244 and then compared to "Tp" at step 246. If "T"<"Tp", the Glow Plug is then powered 248 and steps 244, 246, 248 are repeated until "T" is greater or equal to "Tp". Once "T" reaches "Tp", an "Engine Ready" indication is given 250. This indication can be a light, audible tone, both or other means to indicate to the operator that the engine is ready to be started. In some applications it may be desirable to have the controller initiate an engine start at step 250 instead of merely providing an indication of engine status.

The controller next monitors 252 the engine to determine when it actually starts. A common means to detect engine start is to monitor the voltage from the alternator (not shown). Once the engine start has been detected, the controller retrieves 254 a maximum time value "tmax" and begins a timer (t1) at step 256. The time "t2" is then read at step 258 and "t2–t1" is compared to "tmax" at step 260. If "t2–t1" exceeds "tmax", the process is stopped 262. If "t2–t1" does not exceed "tmax", the glow plug temperature "T" is then read 264 and compared 266 to the desired temperature "Ta"". If "T" is less then "Ta", power is applied to the Glow Plug(s) at step 268 and steps 258, 260, 264, 266 are repeated. When "T" has reached "Ta", step 268 is bypassed (the Glow Plug(s) are not powered) and steps 258–266 are repeated until step 262 is reached, i.e., "t2–t1" >"tmax".

According to still another embodiment, an exhaust sensor is provided. The exhaust sensor produces an analog signal whose value is a function of the presence of a particular sensed component or components of engine exhaust. The present embodiment adjusts glow plug operation as a function of the amount of one or more of the particular sensed exhaust components. As in the case of parameters disclosed in connection with the previously disclosed embodiments, exhaust sensors are well known in the art. Such sensors can detect the presence of various exhaust components. Detection of exhaust components give rise to information relating to the degree of completeness of combustion of the fuel in the engine cylinders. The presence of smoke, resulting from particulate matter, usually indicates incomplete combustion. So does a relatively high fraction of oxygen in the exhaust.

As with other types of exhaust sensors, oxygen exhaust sensors are well known in the art. Such a sensor is used to provide an analog signal whose value indicates the amount of sensed oxygen in the exhaust. This value is digitized for subsequent handling by the digital logic circuitry. After processing by the digital logic circuitry, the digital logic circuitry produces an output for governing glow plug operation. That output is reconverted to analog form and used to control the glow plug.

In the present embodiment, the amount of glow plug heating is increased in response to the increased sensing of exhaust components which result from incomplete combustion. Accordingly, as sensed oxygen rises, the glow plug controller adjusts the glow plugs to provide additional heating.

In this embodiment, the amount of additional glow plug heating is a function of the amount of oxygen sensed in the exhaust during the last previous period of operation. A non-volatile memory is provided for storing the output of the exhaust sensor. The memory saves the stored value until the engine is restarted, at which time it adjusts glow plug operation as a function of the stored data representing earlier exhaust component information.

Figure 5:
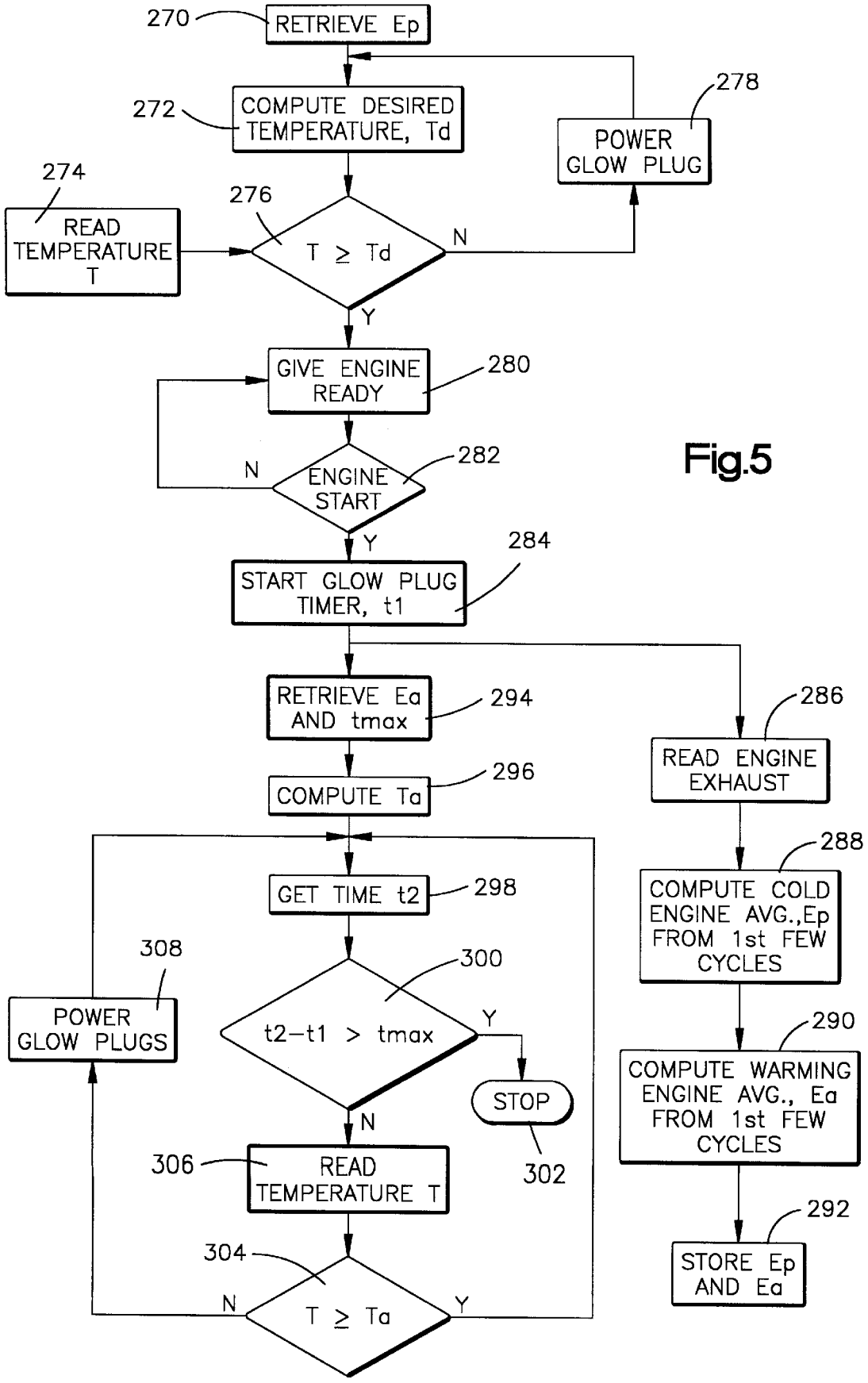

FIG. 5 is a flow chart setting forth the manner of programming the digital logic circuitry in order to accomplish the function of this particular embodiment. The method of programming is virtually identical to that of FIG. 4, except that a different variable is being sensed.

The steps shown in FIG. 5 begin with retrieving the average exhaust oxygen "Ep" (step 270). "Ep" is as computed and stored in a previous cycle of operation or is a factory set default on the first cycle of operation or after a reset. A "look up" table or stored algorithm is then used to compute a desired temperature "Td" for engine starting in step 272. A suitable "look up" table or algorithm could be readily determined from empirical studies of oxygen emissions from starting engines spanning a range of "Cold Engine" starting temperatures. Once a "Td" has been determined, the glow plug temperature "T" is read in step 274. "T" is then compared to "Td" in step 276. If "T"<"Td", power is applied to the Glow Plug(s) in step 278. Steps 274 through 278 are then repeated until "T" equals or exceeds "Td". After "T" has risen to "Td" an "Engine Ready" indication is given in step 280. This indication can be a light, audible tone, both or other means to indicate to the operator that the engine is ready to be started. In some applications it may be desirable to have the controller initiate an engine start at step 280 instead of merely providing an indication of engine status. The controller then monitors the engine to determine when it actually starts (step 282). A common means to detect engine start is to monitor the voltage from the alternator (not shown). Once the engine start has been detected, the controller begins a timer at step 284(t1). During the first few cycles of operation after engine start, the exhaust oxygen is read (step 286) and a "Cold Engine" average exhaust oxygen "Ep" is computed (step 288). During the first "n" cycles of operation after engine start, the exhaust oxygen is read (step 286) and a "Warm Engine" average exhaust oxygen "Ea" is computed at step 290. Once an "Ep" and an "Ea" have been computed, they are stored at step 292 where they will be available for retrieval during the next engine starting sequence. Concurrent with initiation of steps 286–292, the previous "Ea" and a predetermined maximum time "tmax" are retrieved at step 294. "Ea" is then used to compute a desired engine operating temperature "Ta" at step 294. "Ea" is then used to compute a desired engine operating temperature "Ta" at step 294. As in step 272, an empirically determined "look up" table or algorithm can be used to compute "Ta". The time "t2" is then measured at step 298 and the difference "t2–t1" is compared to "tmax" at step 300. If the difference exceeds "tmax", the controller is stopped (step 302) and power to the glow plug(s) is discontinued. If the difference does not exceed "tmax", the glow plug temperature "T" is read at step 306 and compared to the desired operating temperature "Ta" at step 304. If "T"<"Ta", power is applied to the glow plus(s) at step 308 and steps 296–308 are repeated. If "T" equals or exceeds "Ta", step 308 is skipped and control is transferred back to step 296 where the process can repeat until step 302 is reached.

In certain applications it will be desirable to add a data communications link with an engine control module (ECM). On many diesel platforms there is an ECM reading iniformation from exhaust, temperature, barometric and/or other existing sensors. In some cases the ECM reads sensors such as a barometric pressure sensor that are used in glow plug control algorithms such as that in FIG. 4. In such cases a single data connection to the ECM is used to eliminate the additional signal lines and/or sensors that would be required for the controller to obtain these values.

Figure 8:
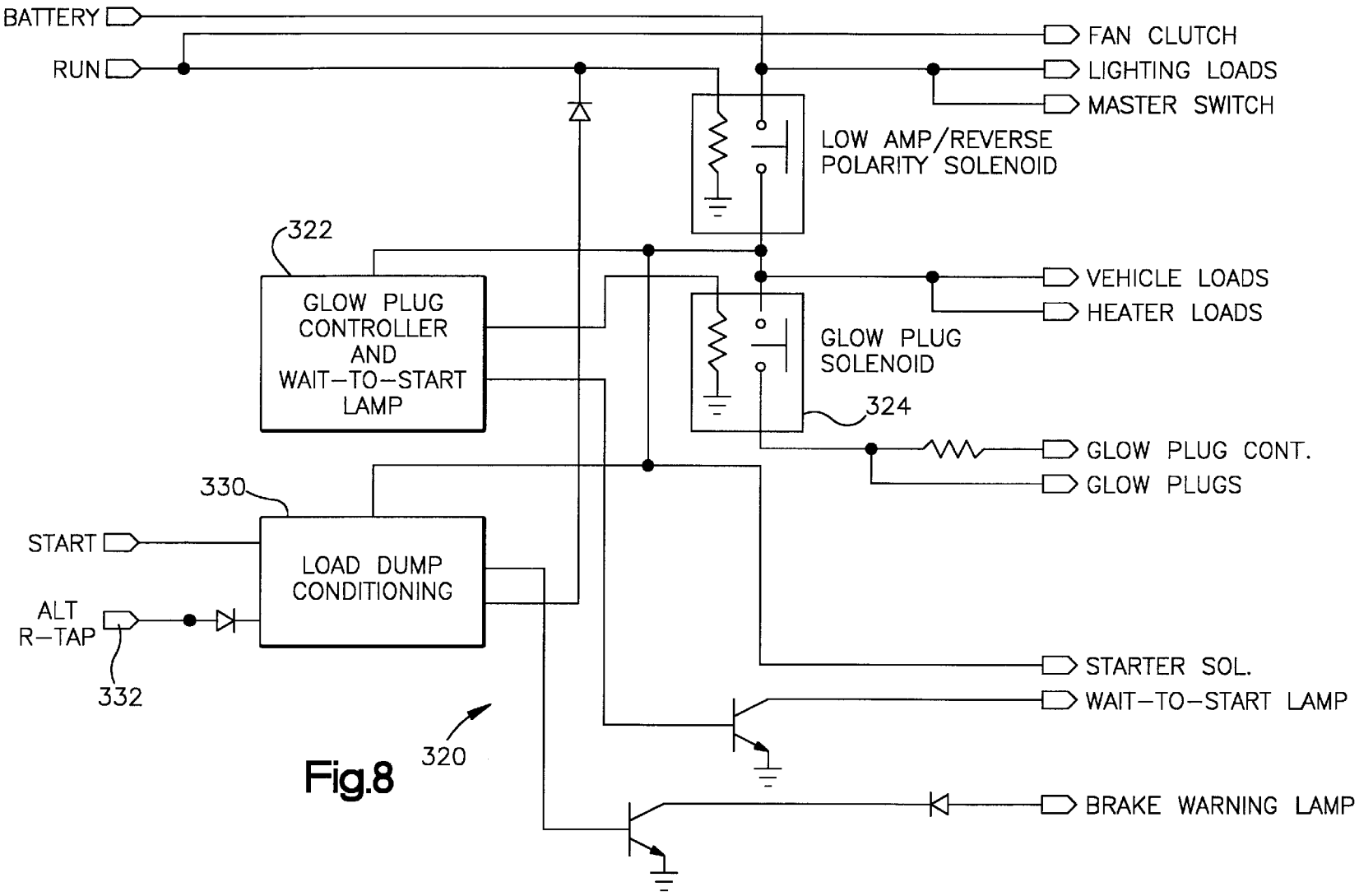
FIG. 8 is a block diagram of a controller circuit that implements an electrical engine starting system having load dump control circuitry, reverse voltage protection, frequency controlled circuity and filtration.

FIG. 8 depicts an electrical engine starting system 320 that provides protection for a starter system of a vehicle having an internal combustion diesel engine. As described above, a controller 322 controls a wait to start lamp and energizes a glowplug solenoid 324 in response to sensed conditions. The wait-to-start lamp and associated comparator and latching circuitry is provided for actuating the wait lamp in response to initiation of a glow plug controller pre-glow operation, and for subsequently extinguishing the lamp. Once extinguished, the lamp cannot be re-actuated until and unless the ignition has been toggled. As described above, the system 320 includes a field effect transistor for controlling glow plug controller operation by means of an auxilary solenoid.

Load dump control circuitry 330 responds to frequency to voltage conversion to inhibit disconnection of electrical loads from a engine driven alternator input 332 even when the motor vehicle ignition is turned off until engine speed has dropped to a safe level. This prevents voltage spikes which could otherwise result from a sudden unloading of the alternator, a phenomenon which could damage a voltage regulator or other electrical circuitry. The controller 322 also controls or maintains an afterglow operation subsequent to engine combustion.

It should be noted that the digital logic circuitry needed to practice the invention does not require use of a microprocessor. Rather, the function of the microprocessor described above can often suitably be performed by the use of either a programmable logic device (PLD) or by a custom logic device (CLD). A programmable logic device is a well known type of digital logic circuit package consisting of an array of gates, comparators, and the like. A programmable logic device can be programmed, or configured, to present to an input one of a plurality of sets of gate arrays. Each gate array constitutes digital logic circuitry for controlling the pattern, or program, with which the programmable logic device responds to an input to create an output.

A custom logic device is somewhat similar to a programmable logic device, in that it constitutes an array of gates. A custom logic device, however, cannot be pre-configured to present a plurality of sets of gate arrays. Rather, a custom logic device embodies only one array of gates, and that configuration cannot be altered without substantially changing the circuitry.

It should be appreciated that the present invention has been described with a certain degree of particularity, but that this illustration is not intended to limit the scope of the invention. It is therefore the intent that the invention include all modifications and alterations falling within the spirit and scope of the invention, as defined in the appended claims.

We claim:

1. A glow plug controller for a motor vehicle diesel engine comprising:

a) an electric power source mounted to the motor vehicle for providing a power supply signal;

b) glow plug controller circuitry powered by the power source for determining a glow plug pre-combustion preglow energization cycle for heating one or more glow plugs;

c) a monitor coupled to the glow plug controller for providing a signal indicative of a voltage output of the electric power source;

d) a switching device coupled to the glow plug controller and the electric power source for energizing the one or more glow plugs for the preglow energization cycle prior to initiating combustion in the diesel engine; and e) said glow plug controller including an adaptive control program for adjusting the preglow energization cycle during which the one or more glow plugs are energized prior to combustion, the preglow energization cycle being adjusted based on the voltage output of the electric power source.

2. The glow plug controller of claim 1 wherein the monitor monitors a voltage output from the electric power source.

3. The glow plug controller of claim 1 additionally comprising a temperature sensor for determining a temperature of a portion of the diesel engine and wherein the controller also energizes the one or more glow plugs after combustion for an afterglow cycle that is based on the sensed engine temperature and voltage output of the electric power source.

4. The glow plug controller of claim 1 wherein the controller senses an operational state of the motor vehicle and disables a preglow energization cycle if the diesel engine has been running or has had a preglow cycle within a specified time period.

5. The glow plug controller of claim 4 wherein the controller senses running of the diesel engine based upon an output of the motor vehicle alternator.

6. The glow plug controller of claim 1 wherein the controller comprises a microprocessor executing a control program that adjusts the preglow energization cycle based on a voltage output by the electric power source which includes a vehicle battery.

7. The glow plug controller of claim 1 further comprising means to activate a visual indicator to signal an operator that the preglow energization cycle is completed and the engine should be started.

8. The glow plug controller of claim 1 additionally comprising means for preventing damage to the switching device by application of too large a voltage signal.

9. The glow plug controller of claim 8 wherein the means for preventing damage to the switching device senses over voltage signals applied to the one or more glow plugs.

10. The glow plug controller of claim 8 wherein the means for preventing damage to the switching device senses over current signals applied to the one or more glow plugs.

11. The glow plugs controller of claim 1 further comprising an input circuit coupled to the glow plug controller circuitry for transmitting a signal to the glow plug controller circuitry indicative of an operating condition of the diesel engine and wherein the glow plug controller circuitry deactivates glow plug energization based on a sensed operating condition of the diesel engine.

12. The glow plug controller of claim 11 wherein the input circuit monitors a signal related to a running status of the diesel engine.

13. The glow plug controller of claim 12 wherein the glow plug controller circuitry disables a preglow energization cycle if the engine has been sensed as running or an ignition input has been sensed within a specified time period of receipt of an additional ignition input.

14. The glow plug controller of claim 12 wherein the glow plug controller deactivates glow plug energization if an engine running condition is sensed when power is applied to the glow plug controller circuitry.

15. The glow plug controller of claim 12 wherein the glow plug controller circuitry terminates a pre-glow energization cycle of the glow plugs upon receipt of the signal indicating a running diesel engine during a pre-glow energization cycle and begins a post combustion afterglow energization cycle.

16. The glow plug controller of claim 1 additionally comprising a temperature sensor and wherein the glow plug controller circuitry briefly activates an indicator lamp if the sensed temperature is greater than a threshold temperature such that a preglow energization cycle is not needed.

17. A method for controlling a glow plug controller for a diesel engine that provides motive power to a motor vehicle, the steps of the method comprising:

a) providing a power supply source mounted to the motor vehicle, the power supply source generating a signal for energizing one or more glow plugs of a diesel engine;

b) monitoring an energization signal for energizing one or more glow plugs prior to engine combustion and providing an indication of said energization signal; and c) activating one or more glow plugs with a timing signal derived from the energization signal for a controlled preglow cycle time before starting the diesel engine, wherein the controlled preglow cycle time is adjusted based on an output voltage of the power supply source.

18. The method of claim 17 additionally comprising the step of adjusting the controlled preglow cycle time based on a temperature of the diesel engine.

19. The method of claim 17 additionally comprising the step of applying a heating signal to the one or more glow plugs during an afterglow energization cycle after the engine has started.

20. The method of claim 19 wherein during the afterglow energization cycle the one or more the glow plugs are energized with a sequence of on and off periods wherein the one or more glow plugs are alternately energized and deenergized.

21. The method of claim 18 additionally comprising the step of adjusting the controlled cycle time based on whether the engine is running.

22. The method of claim 17 additionally comprising the step of providing a visual indication to the operator of the motor vehicle that the engine can be started after the controlled preglow energization cycle has transpired.

23. The method of claim 17 wherein the energization signal that is monitored is a voltage related to the voltage applied to the one or more glow plugs.

24. The method of claim 17 additionally comprising the step of sensing a temperature of the engine and if the sensed temperature is above a threshold temperature activating a visual indicator for a brief interval without commencing a controlled preglow energization cycle.

25. The method of claim 21 wherein if the engine is running when power is applied to a programmable controller for activating the glow plugs, the one or more glow plugs are not energized.

26. The method of claim 17 wherein a running condition of the engine is sensed and if a running condition is sensed during a controlled preglow energization cycle, the controlled preglow energization cycle is terminated and an afterglow energization cycle is commenced.

27. Apparatus for use with a motor vehicle diesel engine comprising:

a) an electric power source mounted to the motor vehicle for providing a power supply signal by means of an ignition signal;

b) controller circuitry powered by the power source for determining a glow plug pre-combustion preglow energization cycle during which one or more glow plugs are energized prior to initiating combustion of the diesel engine, the preglow energization cycle being adjusted based on power applied to the one or more glow plugs by the electric power source;

c) a monitor coupled to the controller circuitry for providing a signal indicative of power applied to the one or more glow plugs;

d) a switching device coupled to the glow plug controller and the electric power source for energizing the one or more glow plugs for the preglow energization cycle prior to initiating combustion in the diesel engine; and e) circuitry for maintaining power to current drawing loads of the motor vehicle after removal of the ignition signal.

28. The apparatus of claim 27 wherein circuitry for maintaining power to the current drawing loads monitors a frequency output from an alternator signal to determine when to remove the alternator signal from the current drawing loads of the motor vehicle.

29. The apparatus of claim 28 additionally comprising reverse voltage protection means.

30. The apparatus of claim 27 wherein the signal provided by the monitor is indicative of a voltage output of the electric power source.

31. The apparatus of claim 30 wherein a duration of the preglow energization cycle is adjusted based the voltage output of the electric power source.

32. The apparatus of claim 30 additionally comprising a temperature sensor for determining a temperature of a portion of the diesel engine and wherein the switching device also energizes the one or more glow plugs after combustion for an afterglow cycle that is based on the sensed engine temperature and the voltage output of the electric power source.

33. The apparatus of claim 27 wherein the apparatus senses an operational state of the diesel engine and disables a preglow energization cycle if the diesel engine has been running or has had a preglow cycle within a specified time period.

34. The apparatus of claim 33 wherein the apparatus senses running of the diesel engine based upon an output of the motor vehicle alternator.

* * * * *